US006260517B1

(12) United States Patent
Powers et al.

(10) Patent No.: US 6,260,517 B1
(45) Date of Patent: Jul. 17, 2001

(54) MARINE PROPULSION SYSTEM WITH WATER DETECTING SENSORS

(75) Inventors: Loren T. Powers; James M. Horak, both of Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/620,326

(22) Filed: Jul. 19, 2000

(51) Int. Cl.[7] ..... B63H 21/38
(52) U.S. Cl. ..... 123/41.15
(58) Field of Search ..... 123/41.15; 73/29 OR, 73/291, 301, 304 R

(56) References Cited

U.S. PATENT DOCUMENTS

| | | | | |
|---|---|---|---|---|
| 3,873,927 | | 3/1975 | Overall . | |
| 4,011,536 | * | 3/1977 | Bell et al. | 73/290 |
| 4,328,825 | * | 5/1982 | Bidhai | 137/172 |
| 4,788,444 | * | 11/1988 | Williams | 250/577 |
| 5,474,261 | | 12/1995 | Stolarczyk . | |
| 5,531,619 | * | 7/1996 | Nakase et al. | 440/1 |
| 5,628,285 | | 5/1997 | Logan et al. . | |
| 5,793,294 | * | 8/1998 | Schepka | 73/304 R |
| 5,835,018 | * | 11/1998 | Kursel et al. | 73/304 R |
| 5,861,811 | * | 1/1999 | Lease et al. | 73/304 R |
| 5,970,428 | | 10/1999 | Brennan . | |
| 6,098,457 | * | 8/2000 | Poole | 73/295 |

* cited by examiner

*Primary Examiner*—Marguerite McMahon
(74) *Attorney, Agent, or Firm*—William D. Lanyi

(57) ABSTRACT

A marine propulsion system is provided with a liquid detector located within a cooling passage of the cooling system of an engine. Conductivity sensors, or other types of liquid sensors, provide signals representative of the absence or presence of water at particular locations within the cooling system. The signals are used to energize and de-energize various annunciators on a display panel to inform the operator of a marine vessel of the status of a draining procedure. When all of the annunciators properly indicate the absence of water within strategic locations of the cooling system, the marine vessel operator can be assured that the draining procedure has been effectively completed.

10 Claims, 3 Drawing Sheets

MARINE PROPULSION SYSTEM WITH WATER DETECTING SENSORS

BACKGROUND OF THE INVENTION

1. Field of the Invention

The present invention is generally related to a marine propulsion engine and, more particularly, to a marine propulsion engine with a cooling system in which conductivity sensors are used to detect the presence of water at specifically chosen locations within the cooling system to assure that the cooling system is properly drained so that potential freezing water damage can be avoided.

2. Description of the Prior Art

Marine propulsion devices often have cooling systems that require the water to occasionally be drained from the cooling system. This is particularly true when is the marine vessel is stored during winter months. If the water within the cooling system is not properly drained, freezing can cause severe damage to the engine of the marine propulsion device. This is particularly true in marine vessels that utilize a sterndrive or inboard propulsion system. An internal combustion engine, which is located within the marine vessel, is typically provided with a plurality of cavities within the engine block to circulate cooling water in thermal communication with the heat producing portions of the engine, such as the cylinders and combustion chambers. In addition, numerous hoses and other conduits are associated with the engine to facilitate the flow of cooling water through the various portions of the engine that are in thermal communication with the combustion chambers. When the marine vessel is stored over the winter months, it is necessary that all of the water be removed from the cooling system to avoid the potentially serious damage that can be caused if the water within the cooling system freezes.

U.S. Pat. No. 5,628,285, which issued to Logan et al on May 13, 1997, discloses a drain valve for a marine engine. The drain valve assembly is used for automatically draining water from a cooling system of an inboard marine engine when the ambient temperature drops to a preselected value. The drain valve includes a cup-shaped base having a group of inlets connected to portions of a cooling system of the engine to be drained, and the open end of the base in enclosed by a cover. Each inlet defines a valve seat and a sealing piston is mounted for movement in the base and includes a series of valve members that are adapted to engage the valve seats. An outlet is provided in the side wall of the cup-shaped base. The valve members on the sealing piston are biased to a closed position by a coil spring and a temperature responsive element interconnects the sealing piston with the cover. The temperature responsive element is characterized by the ability to exert a force in excess of the spring force of the coil spring when the ambient temperature is above approximately 50 degree F., to thereby maintain the valve member in the closed position. When the temperature falls below the selected temperature, the temperature responsive element will retract, thereby permitting the valve members to be opened under the influence of the spring to automatically drain water from the cooling system of the engine.

U.S. patent application Ser. No. 09/400,675 (M09334) which was filed by Logan et al on Sep. 21, 1999, and assigned to the assignee of the present application, discloses an engine cooling system that is provided with a manifold that is located below the lowest point of the cooling system of the engine. The manifold is connected to the cooling system of the engine, a water pump, a circulation pump, the exhaust manifolds of the engine, and a drain conduit through which all of the water can be drained from the engine.

U.S. Pat. No. 3,873,927, which issued to Overall et al on Mar. 25, 1975, describes a system for detecting wet and icy surface conditions. The system is intended to detect wet and icy conditions on the surface of highways, airport runways, and the like. A first capacitor is positioned on a surface the condition of which is being detected. This capacitor has first and second spaced apart electrodes which are positioned substantially coplanar with the surface and exposed to atmospheric precipitation which affects the capacitor's dielectric and capacitance characteristics. A second capacitor having first and second spaced apart electrodes is positioned so as not to be exposed to atmospheric precipitation. Respective out-of-phase time varying signals are applied to the first electrodes of the capacitors and the second electrodes are commonly connected. The system further includes a conductivity sensor having a first and second spaced apart electrodes exposed to atmospheric precipitation which affects the sensor's resistance, a sensor circuit which supplies an output voltage the magnitude of which is a function of the resistance of the sensor, and a logic circuit responsive to any signal coupled to the second electrodes of the capacitors reaching a predetermined precipitation threshold magnitude and to the output voltage of the sensor circuit reaching a predetermined ice threshold magnitude to provide an output which indicates an icy surface condition.

U.S. Pat. No. 5,474,261, which issued to Stolarczyk et al on Dec. 12, 1995, describes an ice detection apparatus for transportation safety. One embodiment of the invention is an ice detection system that comprises a network of thin, flexible microstrip antennas distributed on an aircraft wing at critical points and multiplexed into a microcomputer. Each sensor antenna and associated electronics measures the unique electrical properties of compounds that accumulate on the wing surface over the sensor. The electronics include provisions for sensor fusion wherein thermocouple and acoustic data values are measured. A microcomputer processes the information and can discern the presence of ice, water frost, ethylene-glycol or slush. A program executing in the microcomputer can recognize each compound's characteristic signal and can calculate the compound's thicknesses and can predict how quickly the substance is progressing toward icing conditions. A flight deck readout enables a pilot or ground crew to be informed as to whether deicing procedures are necessary and/or how soon deicing may be necessary.

U.S. Pat. No. 5,970,428, which issued to Brennan on Oct. 19, 1999, describes a ground loop detector circuit and method. The circuit and method for an instrument that is used with either a pH sensor or a conductivity sensor is disclosed. In the instrument used with a pH sensor, an AC diagnostic signal is provided to the sensor. A high input impedance diagnostic signal monitor monitors the voltage at a node adjacent the output of the diagnostic signal source. The occurrence of a ground loop causes the voltage at the node to drop. The instrument used with the conductivity sensor, not only monitors current returning to the diagnostic circuitry from the sensor but also uses a high input impedance monitor to monitor the current leaving the diagnostic circuit to the sensor. The relationship between the current from the sensor and the current to the sensor can be used to determine if a ground loop has occurred as such a loop will cause the current from the sensor to be less than the current to the sensor.

When the operator or owner of a marine vessel drains the cooling system of the engine, it is difficult for the operator to be sure that all of the water has been removed. If any of the water is left remaining within the cavities of the engine block or within other conduits of the cooling system, that remaining water can possibly freeze and result in serious damage to the marine propulsion system. It would therefore be significantly beneficial if a system could be provided which informs the operator of the presence or absence of water within critical locations of the cooling system following a draining procedure. It would also be significantly beneficial if signals could be provided to the operator to annunciate the presence or absence of water at these critical locations within the cooling system.

SUMMARY OF THE INVENTION

A preferred embodiment of the present invention provides a marine propulsion engine cooling system that comprises an engine which, in turn, comprises an engine block and at least one cylinder. The cylinder comprises a combustion chamber. A cooling passage is disposed in thermal communication with the engine through which a liquid coolant can flow. A conductivity, or water, sensor is disposed within the cooling passage for providing a signal when an electrically conductive liquid is present within the cooling passage.

In a particularly preferred embodiment of the present invention, a display panel has at least one annunciator which is responsive to a signal from the conductivity sensor for providing information to a marine vessel operator regarding the presence of liquid within the cooling passage.

The cooling passage can be formed as an integral cavity within the engine block or, alternatively, can be a hose or other conduit connected in fluid communication with a cooling conduit within the engine block.

The conductivity sensor can comprise two electrodes disposed within the cooling passage and the display panel can have a first annunciator indicating the presence of the liquid in the cooling passage and a second annunciator indicating the absence of the liquid in the cooling passage.

The present invention provides a discreet signal which informs a marine vessel operator of the presence of the absence of water within various critical locations of the engine block and related hoses and conduits. This provides a certain feedback which assures that a draining procedure has been accomplished successfully and completely.

BRIEF DESCRIPTION OF THE DRAWINGS

The present invention will be more fully and completely understood from a reading of the description of the preferred embodiment, in conjunction with the drawings, in which.

DESCRIPTION OF THE PREFERRED EMBODIMENT

Figure 1:
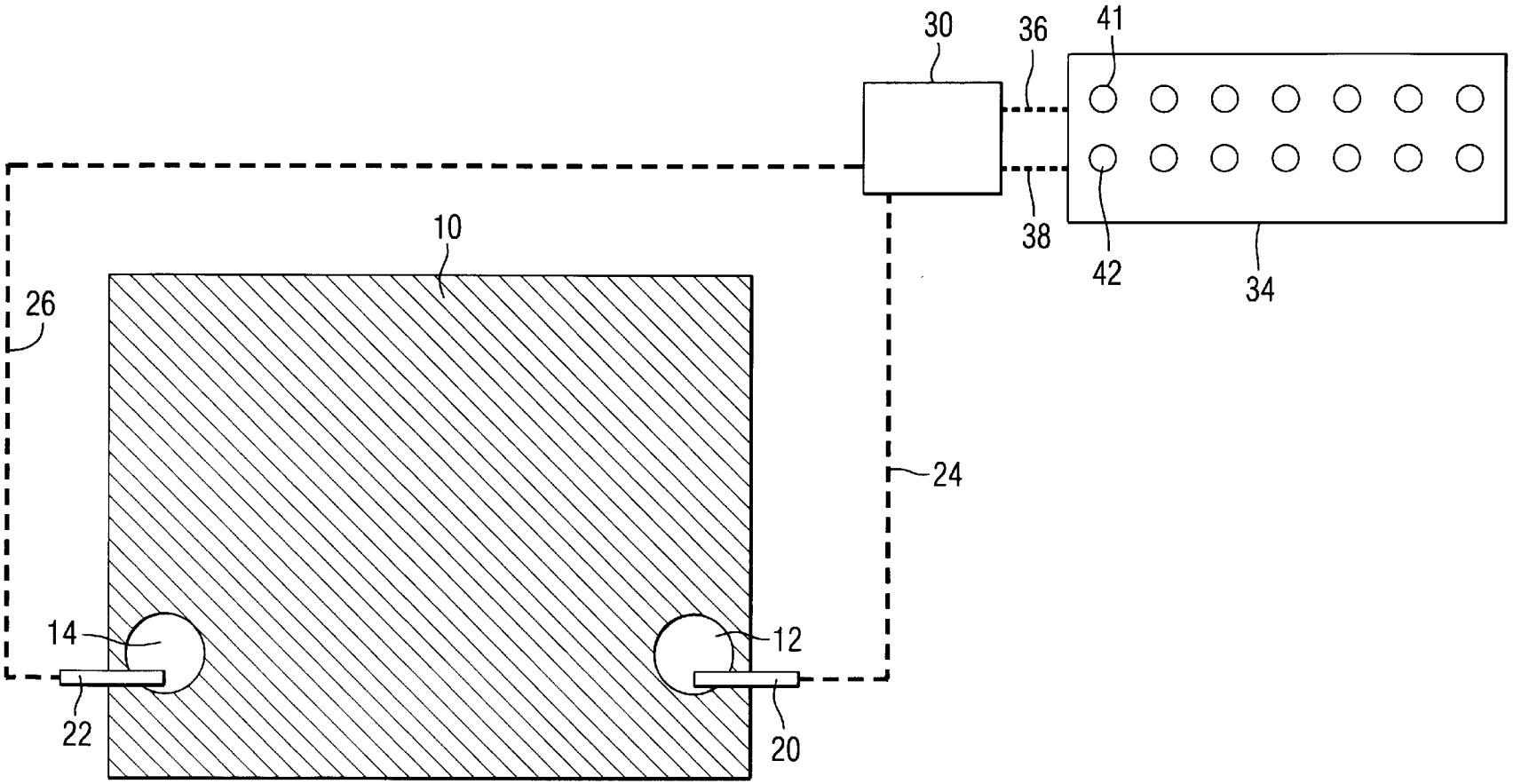
FIG. 1 is a schematic representation of an engine block with cooling passages and detectors connected to a display panel.

Throughout the description of the preferred embodiment of the present invention, like components will be identified by like reference numerals. FIG. 1 is a schematic representation of an engine 10 used in a marine propulsion system. Also schematically represented in FIG. 1 are two exemplary cooling passages, 12 and 14, through which cooling liquid is passed to remove heat from the engine block. Although not shown in FIG. 1, it should be understood that the internal combustion engine 10 comprises at least one cylinder in which a piston is disposed for reciprocal motion. The cylinder comprises a combustion chamber in which a fuel is combusted to cause the piston to move within the cylinder and provide power to a crankshaft. These elements of an internal combustion engine are well known to those skilled in the art and will not be described in detail herein. The cooling passages, 12 and 14, can be formed as integral cavities within the block of the engine 10. Furthermore, other cooling passages can comprise hoses or conduits associated with the engine 10 to conduct water from one portion of the cooling system to another. Disposed within each of the cooling passages, 12 and 14, are conductivity sensors 20 and 22. The purpose of the conductivity sensors is to detect the presence or absence of water within the cooling passages, 12 and 14. The conductivity sensors provide signals, on lines 24 and 26, to a microprocessor 30 or appropriate circuitry to receive the signals on lines 24 and 26 and provide appropriate signals to a display panel 34. The microprocessor 30, or appropriate circuitry, receives signals from a plurality of conductivity sensors and provides signals, on lines 36 and 38, to a plurality of sets of annunciators. For example, annunciator 41 can be an appropriately colored and labeled lamp which represents the condition in which water is located at a particular location, such as in a port exhaust manifold location. Annunciator 42 can be an appropriately colored lamp that indicates the absence of water in that same location, such as the port exhaust manifold. Each pair of annunciators on the display panel 34 represents the wet or dry status of a particular location within the cooling system of the engine 10 and its associated components, such as the exhaust manifolds, the engine block, the sea pump, the fuel cooling mechanism, or the circulating pump of the engine.

Figure 2:
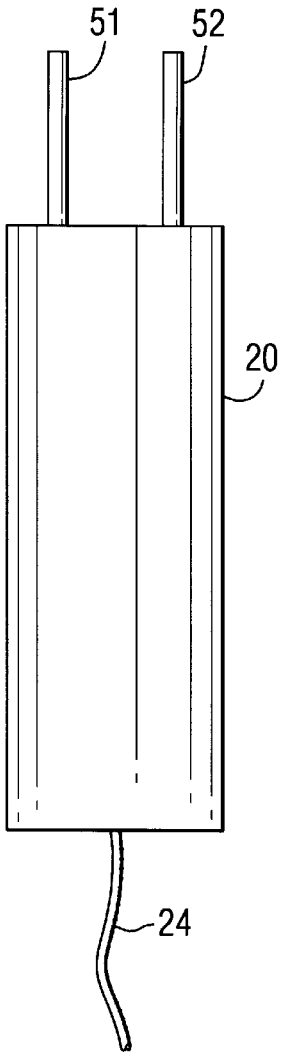
FIG. 2 shows a conductivity sensor.

FIG. 2 is a simplified illustration of an exemplary conductivity sensor 20 such as that illustrated in FIG. 1. Although the type of conductivity sensor used in conjunction with the present invention need not be of a particular type or style, the conductivity sensor 20 shown in FIG. 2 is provided with two electrodes, 51 and 52, which are disposed within the cooling passage being monitored. If the electrodes, 51 and 52, are disposed within a conductive liquid, such as cooling water, an appropriate signal is provided by the conductivity center 20 on conductor 24. As described above in conjunction with FIG. 1, this signal is provided to the microprocessor 30, or appropriate circuitry, to represent the presence or absence of water within the cooling passage 12. It should be understood that the conductivity sensor 20 can be inserted through a drilled hole in the engine block to place the electrodes, 51 and 52, within the internal cavity of the cooling passage 12. When water is present within the cooling passage 12, the signal on line 24 represents the presence of water and this signal is received by the microprocessor 30, or appropriate circuitry, so that an appropriate annunciator can be activated on the display panel 34. Many different types of conductivity sensors are well known to those skilled in the art. Some water sensors operate on a capacitive principle while others merely determine whether or not a conductive liquid is in contact with both of the electrodes, 51 and 52. The precise type of liquid sensor used in conjunction with the present invention is not limiting.

Figure 3:
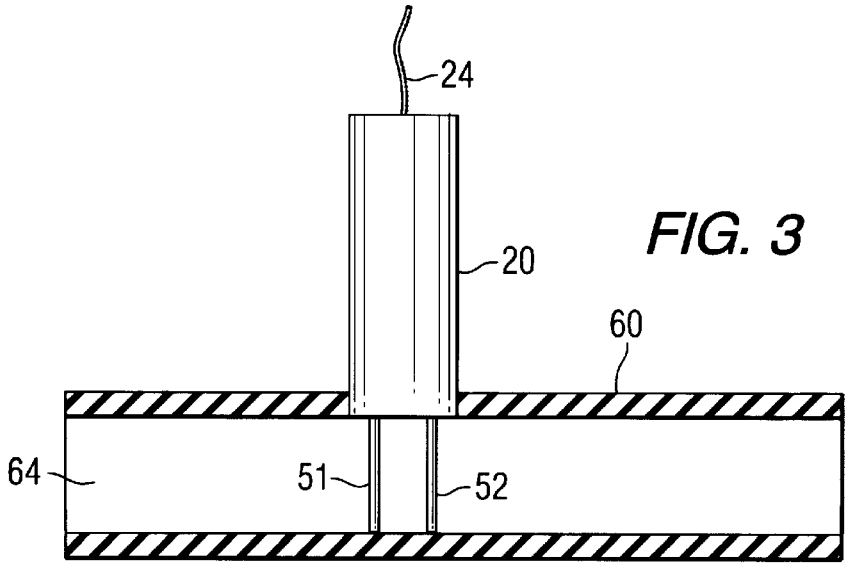
FIG. 3 shows a conductivity sensor associated with a hose.

In the event that the present invention is used to monitor the presence or absence of a conductive liquid within a hose or conduit, the conductivity sensor 20 can be configured in the manner represented in FIG. 3. The conductivity sensor 20 can be associated with a hose 60 in such a way that the electrodes, 51 and 52, are inserted into the internal cavity 64 of the hose 60. It is advisable that the liquid sensor be located at a low point of the hose 60 to increase the likelihood that residual water within the hose 60 will be detected by the conductivity sensor 20.

Figure 4:
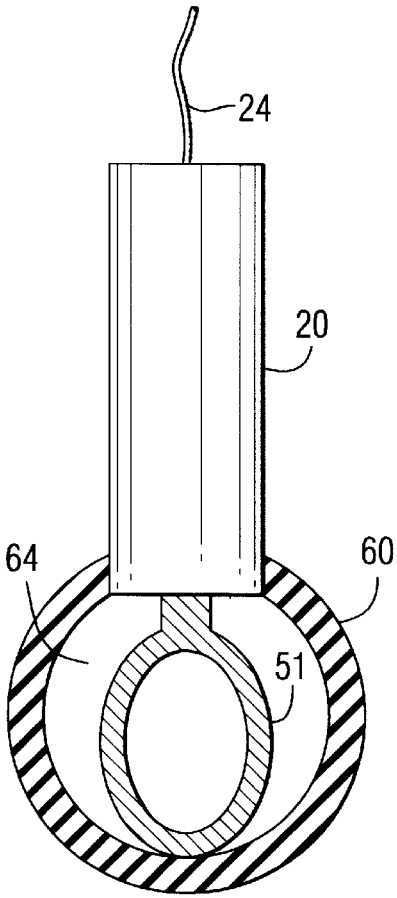
FIG. 4 is a sectional view of a liquid sensor having an electrode disposed within a hose.

FIG. 4 shows a cross section view of one particular configuration of the electrodes, 51 and 52, of the sensor 20. The electrode 51 shown in FIG. 4 allows water to flow through the internal cavity 64 of the hose 60, but is able to work in combination with its associated electrode 52 to detect the presence of water in the region between the electrodes. Only one electrode 51 is illustrated in FIG. 4, but it should be understood that a typical application of the liquid sensor 20 would incorporate two electrodes. The shape of electrode 51 in FIG. 4 can be various different configurations, depending on the application of the sensor.

Figure 5:
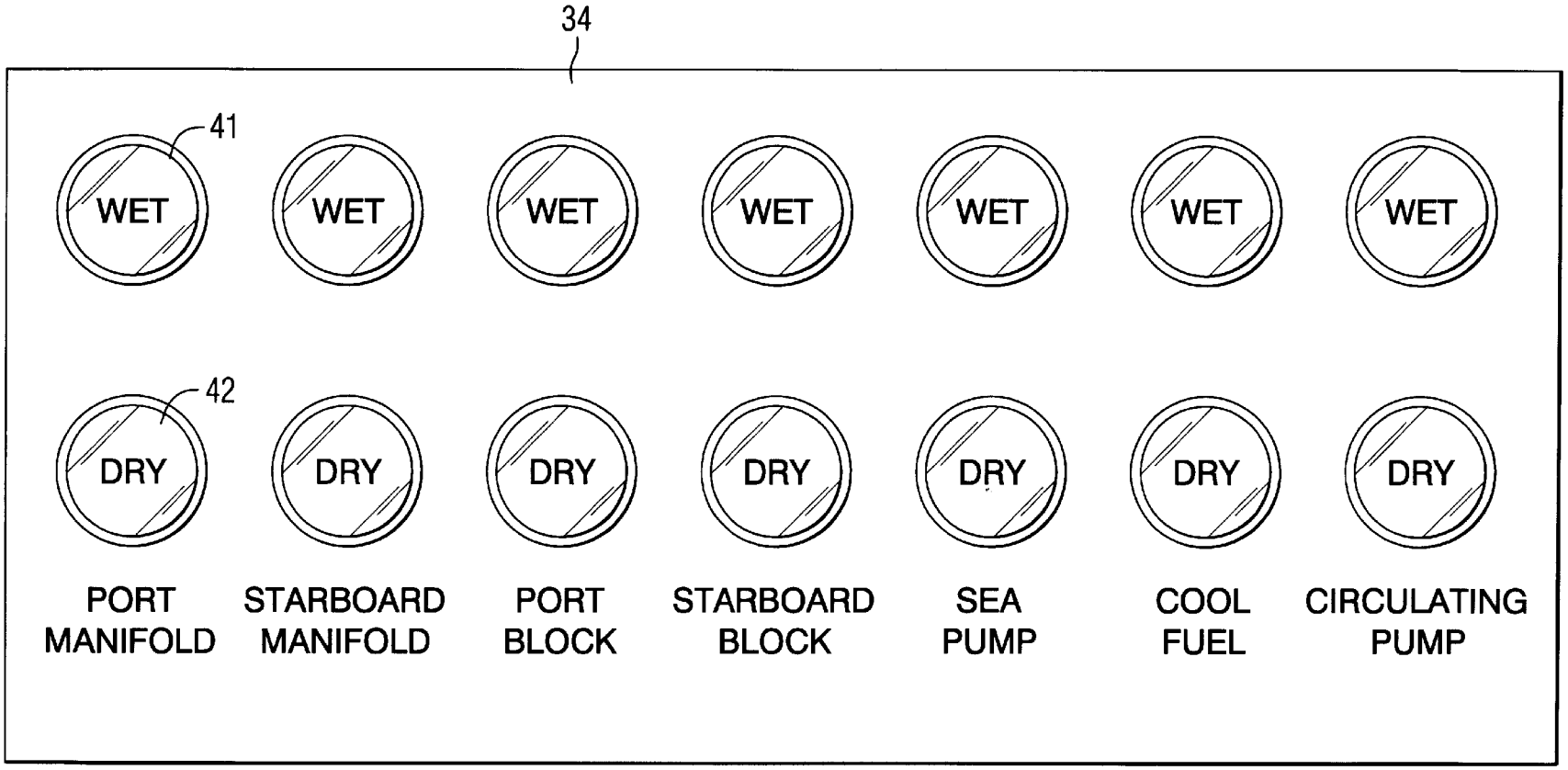
FIG. 5 shows a display panel used in a preferred embodiment of the present invention.

FIG. 5 is a detailed illustration of a display panel 34 such as that described above in conjunction with FIG. 1. Pairs of annunciators, such as the pair identified by reference numerals 41 and 42, are used to describe the wet or dry status of various locations within the cooling system. For example, the activation of the lamp 41 indicates that water is present in the port manifold. Alternatively, if the associated liquid sensor does not sense water in the port manifold, annunciator 42 would be activated. The exemplary annunciators shown in FIG. 5 identify the wet or dry condition of the starboard manifold, port manifold, port block, starboard block, seat pump, fuel cooler, and circulating pump. It should be understood that other locations could also be included in the display. The present invention provides an explicit signal to a marine vessel operator that informs the operator of the effectiveness of a draining operation. When the engine is drained, all of the "DRY" annunciators should be activated and none of the "WET" annunciators should be activated. When all of the proper annunciators are activated, the operator can be assured that the draining procedure has been properly and effectively completed.

Although the present invention has been described with particular detail and illustrated to show one particularly preferred embodiment, it should be understood that alternative embodiments are also within its scope.

What is claimed is:

1. An marine propulsion engine cooling system, comprising:

an engine comprising an engine block and at least one cylinder, said cylinder comprising a combustion chamber;

a cooling passage disposed in thermal communication with said engine through which a coolant can flow;

a conductivity sensor disposed in said cooling passage for providing a signal when an electrically conductive liquid is present within said cooling passage; and a display panel having at least one annunciator, which is responsive to said signal, for providing information to a marine vessel operator regarding the presence of liquid within said cooling passage, said display panel having a first annunciator indicating the presence of said liquid in said cooling passage and a second annunciator indicating the absence of said liquid in said cooling passage.

2. The system of claim 1, wherein:

said cooling passage is formed within said engine block.

3. The system of claim 1, wherein:

said cooling passage is a hose connected in fluid communication with a cooling conduit within said engine block.

4. The system of claim 1, wherein:

said conductivity sensor comprises two electrodes disposed within said cooling passage.

5. An marine propulsion engine cooling system, comprising:

an engine comprising an engine block and at least one cylinder, said cylinder comprising a combustion chamber;

a cooling passage disposed in thermal communication with said engine through which a coolant can flow;

a conductivity sensor disposed in said cooling passage for providing a signal when an electrically conductive liquid is present within said cooling passage, said conductivity sensor comprising two electrodes disposed within said cooling passage; and a display panel having at least one annunciator, which is responsive to said signal, for providing information to a marine vessel operator regarding the presence of liquid within said cooling passage, said display panel having a first annunciator indicating the absence of said liquid in said cooling passage and a second annunciator indicating the presence of said liquid in said cooling passage.

6. The system of claim 5, wherein:

said cooling passage is formed within said engine block.

7. The system of claim 5, wherein:

said cooling passage is a hose connected in fluid communication with a cooling conduit within said engine block.

8. A marine propulsion engine cooling system, comprising:

an engine comprising an engine block and at least one cylinder, said cylinder comprising a combustion chamber;

a cooling passage disposed in thermal communication with said engine through which a coolant can flow;

a conductivity sensor disposed in said cooling passage for providing a signal when an electrically conductive liquid is present within said cooling passage, said conductivity sensor comprising two electrodes disposed within said cooling passage; and a display panel having at least one annunciator, which is responsive to said signal, for providing information to a marine vessel operator regarding the presence of liquid within said cooling passage, said display panel having a first annunciator indicating the presence of said liquid in said cooling passage and a second annunciator indicating the absence of said liquid in said cooling passage.

9. The system of claim 8, wherein:

said cooling passage is formed within said engine block.

10. The system of claim 8, wherein:

said cooling passage is a hose connected in fluid communication with a cooling conduit within said engine block.

* * * * *